United States Patent [19]

Takagi

[11] Patent Number: 4,510,009

[45] Date of Patent: Apr. 9, 1985

[54] VENEER SPLICING APPARATUS

[75] Inventor: Yukio Takagi, Ohbu, Japan

[73] Assignee: Meinan Machinery Works, Inc., Japan

[21] Appl. No.: 530,049

[22] Filed: Sep. 7, 1983

[30] Foreign Application Priority Data

Sep. 25, 1982 [JP] Japan ..... 57-166969

[51] Int. Cl.[3] ..... B65H 19/00

[52] U.S. Cl. ..... 156/353; 156/159; 156/258; 156/304.5; 156/502; 156/518; 156/558; 156/506

[58] Field of Search ..... 156/502, 505, 506, 258, 156/159, 575, 558, 574, 353, 157, 504, 507–509, 304.1, 304.5

[56] References Cited

U.S. PATENT DOCUMENTS

| | | | |
|---|---|---|---|
| 3,562,045 | 2/1971 | Hasegawa | 156/258 X |
| 3,562,069 | 2/1971 | Ortel | 156/546 |
| 3,660,206 | 5/1972 | Ortel | 156/545 |
| 4,042,440 | 8/1977 | Hasegawa et al. | 156/558 X |
| 4,246,063 | 1/1981 | Gronebaum | 156/575 X |

*Primary Examiner*—David A. Simmons

[57] ABSTRACT

A veneer splicing apparatus comprising a veneer detector for detecting the irregular portions of a veneer, disposed before a cutting tool which reciprocates toward and away from conveying means capable of being optionally driven or stopped, with respect to the direction of feeding a veneer; a delivery conveyor disposed after the cutting tool; veneer supporting members each disposed between the cutting tool and the delivery conveyor with one end thereof directed toward the cutting tool and with the other end thereof pivotally supported; an adhesive material feed device to feed adhesive materials, such as adhesive tapes or adhesive-impregnated yarns, near to the veneer cutting position of the cutting tool; said cutting tool or a tool holder being provided with an appropriate number of guide grooves at an appropriate distance away from the cutting edge of the cutting tool; and pressing members integrally mounted on the tool holder on both sides, with respect to the direction of feeding a veneer, of the cutting tool by means of the guide grooves so that the pressing members are capable of being reciprocated toward and away from the veneer cutting position.

6 Claims, 10 Drawing Figures

VENEER SPLICING APPARATUS

BACKGROUND OF THE INVENTION

The present invention relates to a veneer splicing apparatus. It is an object of the present invention to improve the operating speed and to facilitate the maintenance work of an apparatus capable of performing cutting and splicing operation at the same place, such as disclosed in Japanese Patent Publication No. 45-38153.

In the above-mentioned conventional apparatus capable of performing cutting and splicing operations at the same place, pressing members are reciprocated toward and away from a position where a cutting tool cuts a veneer, to press adhesive materials, such as adhesive tapes or adhesive-impregnated yarns, onto the adjacent surfaces of veneers, thus, making the adhesive materials adhere to the surfaces of the veneers.

In such a conventional apparatus, however, the cutting tool needs to be retracted after cutting a veneer to provide a sufficient space for the reciprocating operation of the pressing members with respect to the veneers. Accordingly, in such an apparatus, the stroke of the cutting tool is inevitably greater than that of a simple veneer cutting apparatus, which has been an impediment to raising the veneer processing speed of the cutting and splicing apparatus in which veneer cutting operation is repeated frequently. Furthermore, the provision of both the cutting tool and the pressing members narrows the space available to replace the parts of the cutting tool and the pressing members.

SUMMARY OF THE INVENTION

The present invention has been made to solve those problems of the conventional cutting and splicing apparatus. A veneer splicing apparatus according to the present invention comprises a cutting tool capable of reciprocating toward and away from a conveying member capable of being optionally driven or stopped; a veneer detector for detecting the irregular portions of a veneer, disposed before the cutting tool with respect to the direction of feeding a veneer; a delivery conveyor disposed after the cutting tool; veneer supporting members each disposed between the cutting tool and the delivery conveyor with one end thereof directed toward the cutting tool and with the other end thereof pivotally supported; an adhesive material feed device to feed adhesive materials, such as adhesive tapes or adhesive-impregnated yarns, near to the veneer cutting position of the edged tool; and a pressure unit formed by joining pressure members mounted on opposite sides, with respect to the direction of feeding a veneer, respectively of the edged tool, through a plurality of guide grooves formed in the edged tool or in the tool holder at an optional distance from the edge of the edged tool, and adapted to be reciprocated toward and away from the veneer cutting position.

BRIEF DESCRIPTION OF THE DRAWINGS

The accompanying drawings show a preferred embodiment of a veneer splicing apparatus according to the present invention, in which.

DETAILED DESCRIPTION OF THE EMBODIMENTS

The present invention will be described hereinafter in connection with a preferred embodiment thereof as shown in the accompanying drawings.

Referring to FIGS. 1 to 5, there are shown a feed conveyor 2 for conveying a veneer 1 along a veneer feed path in a predetermined direction, capable of being stopped, and an anvil roller 3. A plurality of annular grooves 4 are formed in the outer circumference of the anvil roller 3 and spaced axially of the anvil roller 3.

Figure 6:
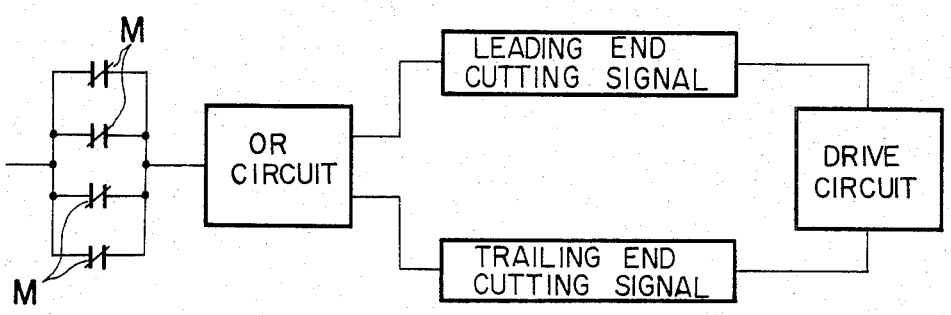
FIG. 6 is a circuit diagram of the controller.
Figure 7:
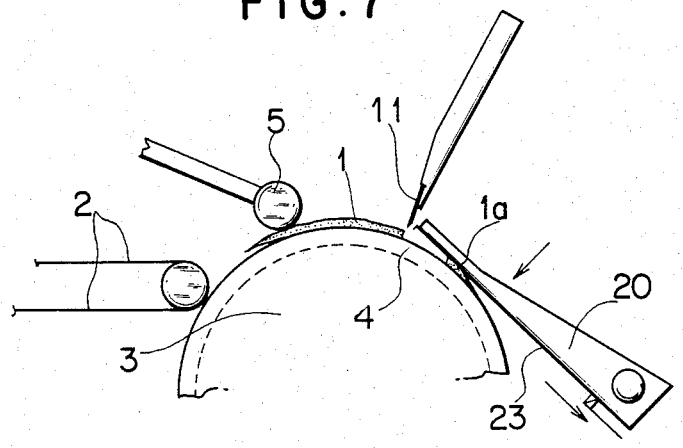
FIGS. 7 to 9 are representations explaining the operation of the veneer splicing apparatus.

A plurality of rollers 5 adapted to be lifted by a distance corresponding to the thickness of the veneer 1 are disposed above the anvil roller 3 on the side of the feed conveyor 2 along a direction perpendicular to the veneer feed direction. Each roller 5 is provided with a microswitch M which is actuated when the corresponding roller 5 is lifted by a predetermined distance. The respective normally-closed contacts of the microswitches M having a suitable timer are connected in parallel as shown in FIG. 6. When all the rollers 5 are lifted by the predetermined distance and when any one of the rollers 5 is lowered from the lifted position, a leading end cutting signal and a trailing end cutting signal, respectively, are provided for cutting the leading or trailing ends thereof after a predtermined period of time.

A pair fo intermittently rotatable rollers R capable of holding continuous adhesive yarns to feed the same, and guide tubes 7 to guide the adhesive yarns 6 to the veneer cutting position are interposed appropriately between the rollers 5. The adhesive yarn 6 is prepared by impregnating a yarn with a melted hot-melting or thermoplastic adhesive or by applying the hot-melting adhesive to a yarn, and then by cooling the hot-melting adhesive.

A nozzle 8 for blowing hot air toward the adhesive yarn 6 being delivered from the guide tube 7 is desposed somewhat above the corresponding guide tube 7.

A tool holder 9 capable of reciprocating, by suitable drive means in response to suitable time-logged signals from microswitch M, toward and away from the anvil roller 3 is provided after the guide tubes 7. A replaceable cutting tool 11 is secured to the tool holder 9 with a tool clamp 10 such that said cutting tool generally extends laterally relative to the feed path. In the tool holder 9, vertical guide grooves 12 having guide ways 13 are formed at positions corresponding to the guide tubes 7 by cutting the upstream side of the tool holder to a depth indicated by broken line II—II in FIG. 1, as illustrated in FIG. 2 showing a front elevation of the tool holder 9 seen from the side of the guide tubes 7. As illustrated in a side elevation in FIG. 3, cooling and pressing members 16 each including a pressing element 16' attached thereto are associated with the corresponding sliding guide ways 13 of the grooves 12 and are connected to the respective lower ends of thin steel strips 14 connected to a pressing member actuator not shown, mounted on the tool holder 9. Each pressing element has an underside surface extending substantially parallelly to the veneer sheets above a splicing line which will be explained later. The cooling and pressing member 16 is provided internally with a water passage 15 to circulate cooling water therethrough, and hoses 17 and 17' for supplying cooling water to and for discharging the same from the water passage 15. Furthermore, the cooling and pressing element 16' is provided on the upstream side of the bottom portion thereof with a cutting knife 24 projecting slightly from the underside surface of the cooling and pressing element 16' to cut the adhesive yarn 6. A groove 18 of a width slightly greater than the thickness of the cutting tool 11 and of a depth greater than the height of the cutting tool 11 is formed in the bottom portion of the cooling and pressing element 16' in parallel to the cutting tool 11 over the entire length thereof to receive the upper portion of the cutting tool 11 so that the up-and-down movement of the cooling and pressing element 16' is guided by the cutting tool 11.

A plurality of veneer supporting members 20 are disposed after the cutting tool 11. Each veneer supporting member 20 is supported pivotally at one end thereof on a rotary shaft provided at the front end of a delivery conveyor 19 for swing motion between a lower position where the leading end thereof is received in the annular groove 4 to guide the veneer to the delivery conveyor 19, and an upper position where the leading end thereof is raised from the annular groove 4 to obstacle the advancement of the veneer onto the delivery conveyor 19. A rubber roller 21 of an axial width greater than that of the annular groove 4 is disposed above each veneer supporting member 20. The rubber roller 21 is continuously held in contact with the veneer supporting member 20. A kicker 23 of the same width as that of the veneer supporting member 20, having a hooked front end is connected to the bottom surface of the veneer supporting member 20 for swing motion together with the veneer supporting member 20 and for independent movement along the direction of the advancement of the veneer.

A control circuit as shown in FIG. 6 is provided to control the operation of the feed conveyor 2 and the anvil roller 3, the supply of the adhesive yarns through the guide tubes 7, the reciprocation of the tool holder 9 for cutting operation, the reciprocation of the cooling and pressing member 16 for pressing operation, the swing motion of the veneer supporting members 20, and the advancement and the retraction of the kickers 23, on the basis of the leading end cutting signal and the trailing end cutting signal provided by the microswitches M of the rollers 5.

The preferred embodiment of the present invention thus constituted operates in the following manner.

Figure 1:
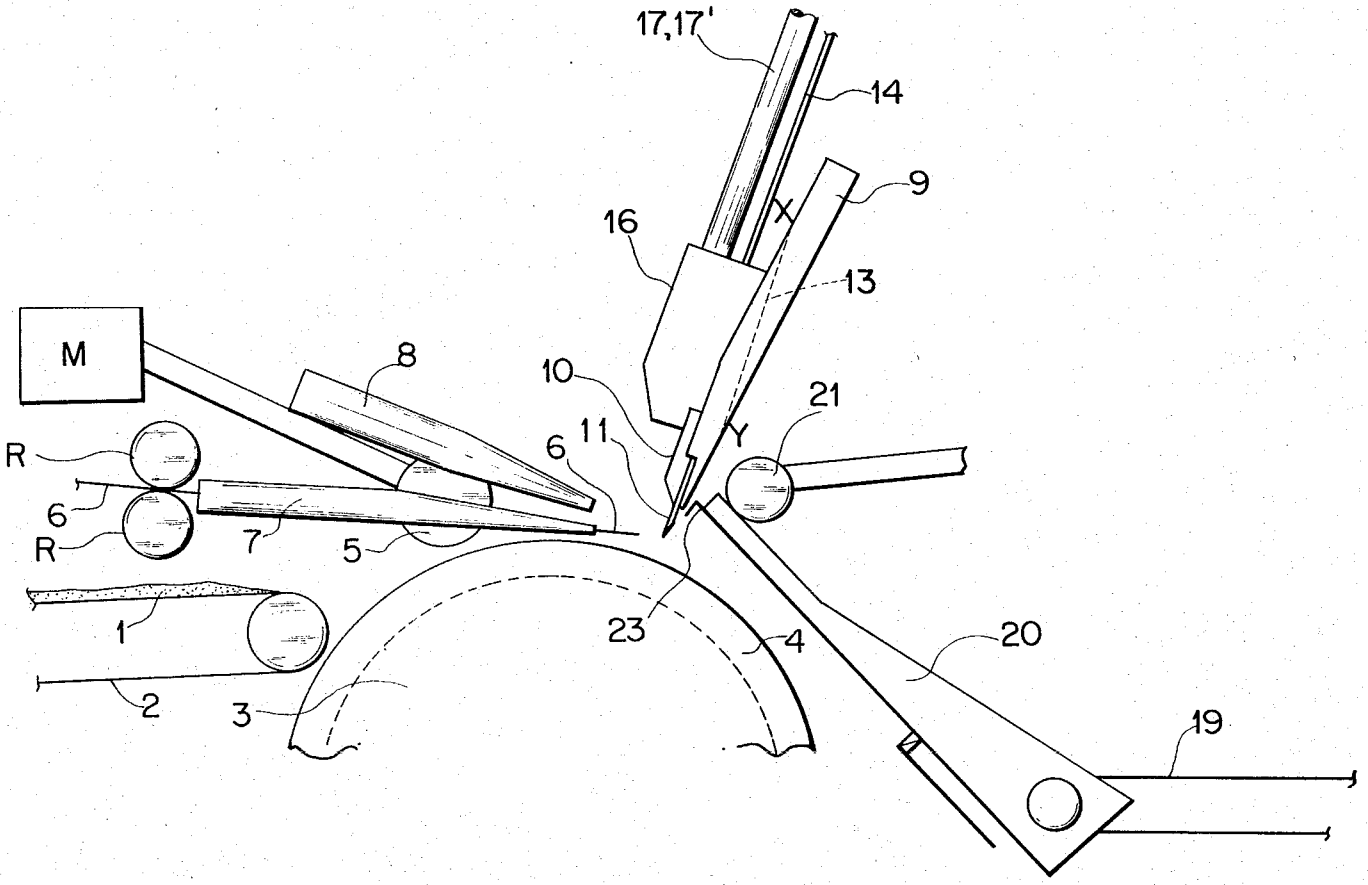
FIG. 1 is a general side elevation of the veneer splicing apparatus.
Figure 2:
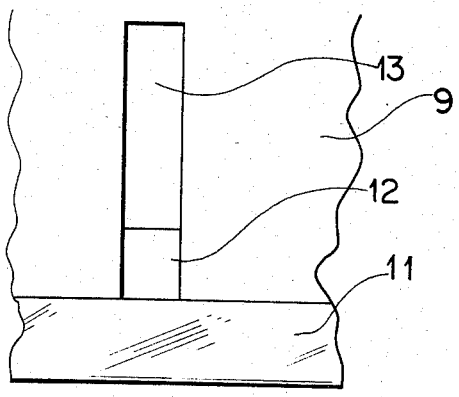
FIG. 2 is a front elevation of the essential part of the veneer splicing apparatus of FIG. 1.
Figure 5:
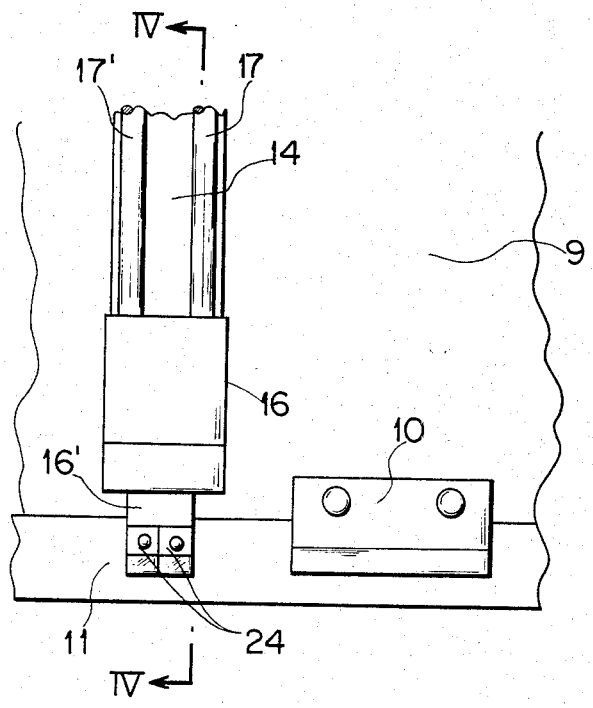
FIG. 5 is a front elevation of the essential part of the veneer splicing apparatus.
Figure 3:
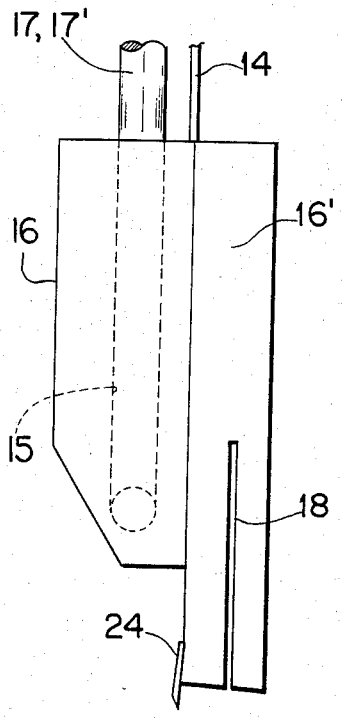
FIG. 3 is an enlarged view of the essential part of the veneer splicing apparatus.
Figure 4:
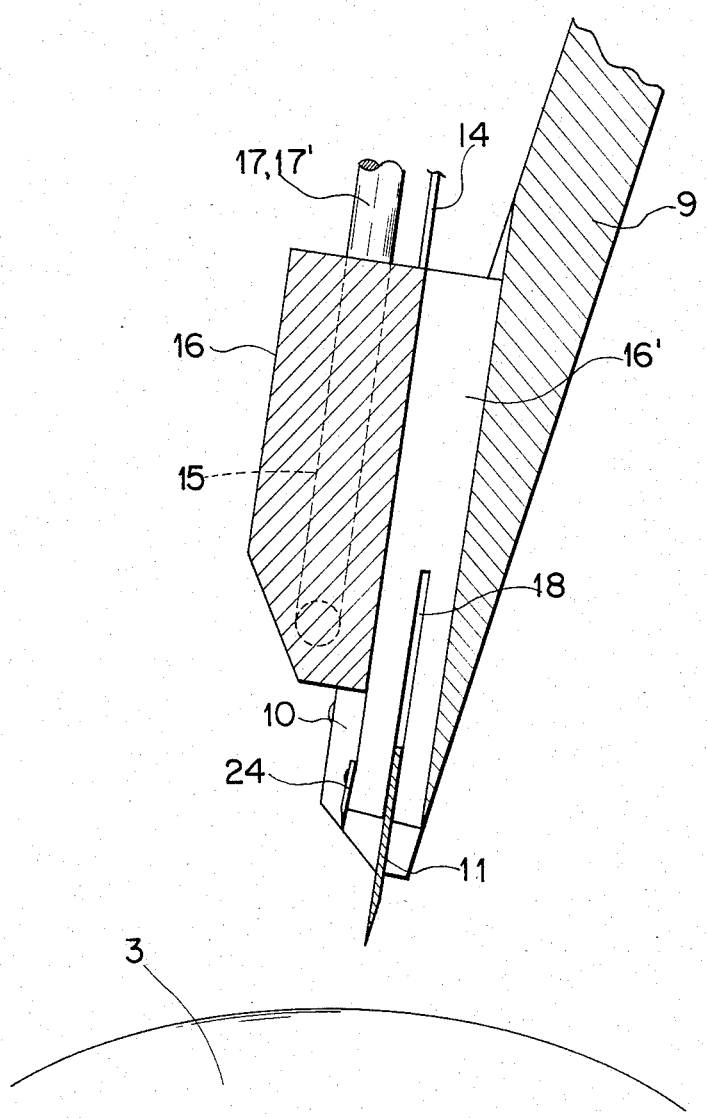
FIG. 4 is sectional view taken along line IV—IV and and seen in the direction of the arrows in the following figure.

Referring to FIG. 1, the veneer supporting members 20, the kickers 23 and the rubber rollers 21 are raised to the respective upper positions, a fixed length of adhesive yarns 6 are drawn out through the guide tubes 7, and then the feed conveyor 2 and the anvil roller 3 are actuated to feed a veneer 1. Then, the rollers 5 are lifted up by the leading end of the veneer 1, so that the normally-closed contacts of all the microswitches M are opened to detect that the veneer 1 of a predetermined thickness is supplied. Consequently, the leading end cutting signal is provided to stop the feed conveyor 2 and the anvil roller 3 and to actuate the tool holder 9 for reciprocating motion to cut the irregular leading end portion of the veneer 1 with the cutting tool 11. Then, the veneer supporting members 20, the rollers 21 and the kickers 23 are moved to the respective lower positions, where the respective hooked ends of the kickers 23 enter the cut part of the veneer 1 and are retracted along the direction of delivery simultaneously to kick out the irregular portion 1*a* from the anvil roller 3.

Figure 8:
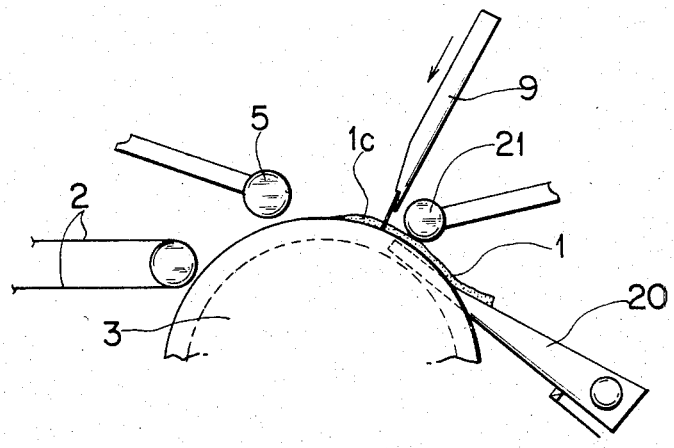

After the irregular portion 1*a* has been removed and the extremities of the veneer supporting members 20 has been received in the annular grooves 4, the feed conveyor 2 and the anvil roller 3 are started again to convey the veneer 1 onto the veneer supporting members 20. When any one of the rollers 5 detects decrease in the thickness of the veneer below the set value, the trailing end cutting signal is provided to stop the feed conveyor 2 and the anvil roller 3, and then the cutting tool 11 is actuated to cut off the irregular trailing end portion 1*c* of the veneer 1 as shown in FIG. 8.

Since the cooling and pressing member 16 is held during the veneer cutting operation at a position where the cooling and pressing member 16 will not obstacle the movement of the tool holder 9 and the cutting tool 11, the cutting tool 11 is enabled to be waiting at a closest possible position relative to the anvil roller 3. Therefore, the cutting cycle time is reduced.

Figure 9:
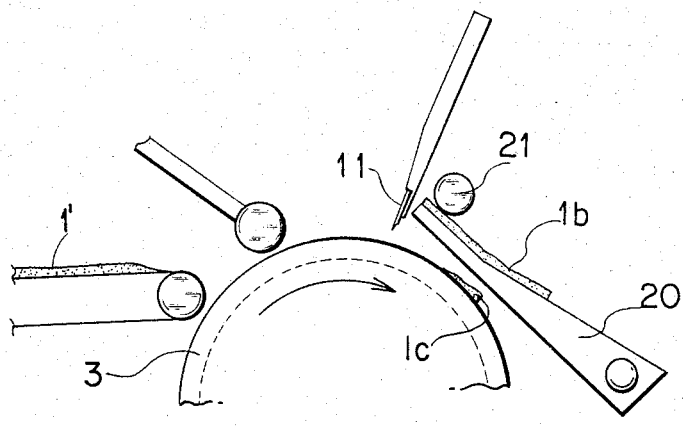
Figure 10:
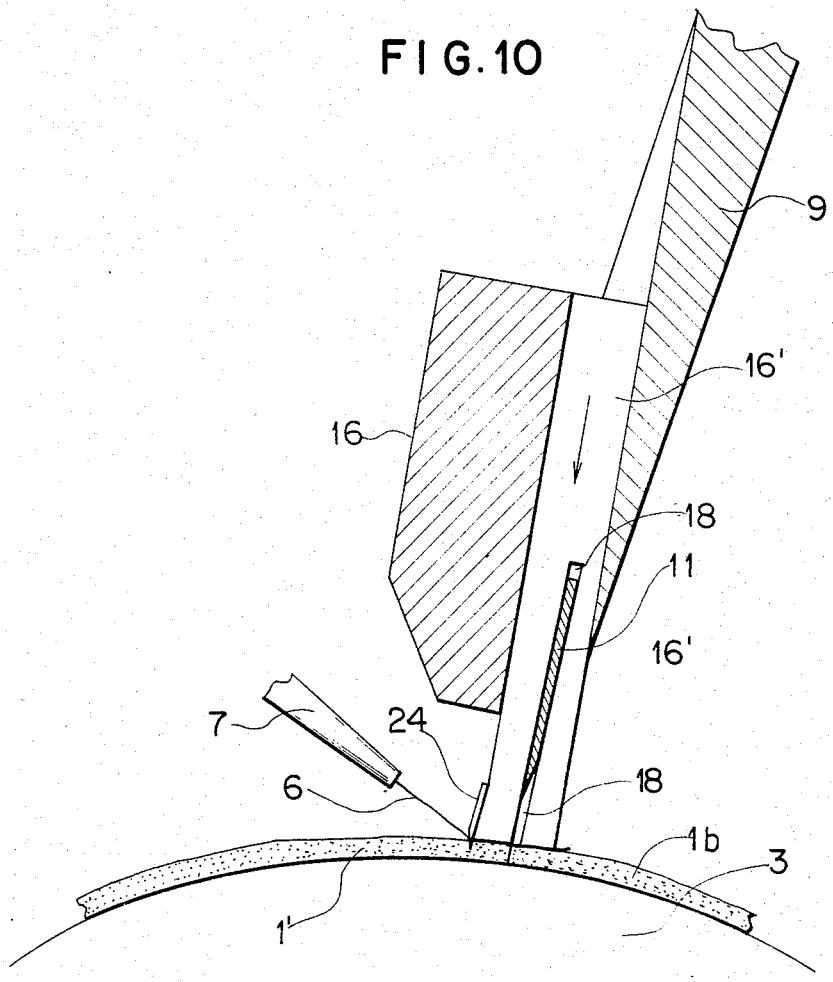
FIG. 10 is a representation explaining the operation of the veneer splicing apparatus.

Referring to FIG. 9, after the irregular trailing end portion 1*c* of the veneer 1 has been cut off, the veneer supporting members 20 are turned clockwise holding the effective portion 1*b* of the veneer 1 between the veneer supporting members 20 and the rollers 21, while the kickers 23 are moved to the extremities of the veneer supporting members 20, and then the feed conveyor 2 and the anvil roller 3 are actuated to remove the irregular trailing end portion 1*c* from the anvil roller 3 and to feed the next veneer 1' onto the anvil roller 3.

The irregular leading and trailing end portions of the veneer 1' are cut off with the cutting tool 11 and are removed with the kickers 23 in the same manner of operation. After the extremities of the veneer supporting members 20 have been received in the annular grooves 4, the leading cut end of the veneer 1' is brought into abutment with the trailing cut end of the effective portion 1*b* on the anvil roller 3 to define a splicing line. Then, the rollers R are actuated to supply a predetermined length of the adhesive yarns 6, which are heated in a melted state by hot air which is blown continuously from the nozzles 8. After the adhesive yarns 6 have been placed over the surfaces of the veneers 1 and 1' across the splicing line, the steel strips 14 are lowered, thus lowering the cooling and pressing members 16 to depress the adhesive yarns 6 onto the effective portion 1*b* and the veneer 1' across the splicing line and to cool the adhesive yarns 6 so that the adhesive yarns 6 adhere to the veneers, thus splicing the veneers. At the same time, the excessive parts of the adhesive yarns 6 are cut off with the knives 24 to leave only the adhering portions of the adhesive yarns 6 on the veneers. The reverse rotation of the rollers R upon the application of the knives 24 to tighten the adhesive yarns 6 will result in satisfactory cutting of the adhesive yarns 6.

After the adhesive yarns 6 have been cut off, the steel strips 14 are raised to lift up the cooling and pressing members 16, and then the feed conveyor 2 and the anvil roller 3 are actuated to carry out a series of the same operations, namely, provision of the trailing end cutting signal, irregular trailing end portion cutting-off operation, the provision of the leading end cutting signal, the irregular leading and portion cutting operation, and the splicing operation, thus continuously splicing the effective portions of veneers.

Part of each adhesive yarn 6 corresponding to the groove 18 of the cooling and pressing member 16 is not present with the cooling and pressing member, which will not affect the splicing strength. It is possible to shift the position of action of the groove 18 from the cutting line of the cutting tool 11 by adapting the tool holder 9 so as to perform a circular motion on a rotary shaft and by reciprocating the cooling and pressing member 16 along the tool holder 9 as described hereinbefore.

As described hereinbefore, according to the present invention, the guide grooves are formed in the cutting tool or in the tool holder at an appropriate distance away from the cutting edge of the cutting tool and the cooling and pressing members are mounted on the tool holder on both sides, with respect to the direction of feeding a veneer, of the cutting tool by means of the guide grooves, therefore, the provision of the cooling and pressing members have nothing to do with the cutting operation of the cutting tool, and hence the cutting tool can be held waiting for cutting operation at a closest possible position to the cutting position. Consequently, the cutting cycle time is reduced, thus improving the productivity of the veneer splicing apparatus in which the cutting operation is repeated frequently.

Furthermore, the present invention provides a sufficient space for changing the cutting tool and the pressing members, thus improving the accessibility of the apparatus.

In the preferred embodiment as described hereinbefore, adhesive yarns are heated to melt the adhesive, and then cooled and pressed with cooling and pressing members, however, adhesive tapes of a preditermined length may be extended on the surfaces of veneers and pressed onto the surfaces of the veneers to splice the veneers with pressing members (in this case, cooling is not necessary) in the same manner as that described with regard to the preferred embodiment.

Furthermore, the pressing members may be guided by any means other than that employed in the preferred embodiment; the tool holder may be provided with a special guide mechanism. The cutting and splicing apparatus may be of a form as disclosed in the Japanese Patent Publication No. 45-38153, in which the kickers employed in the present invention are not necessary. Still further, the pressing members may be mounted on the tool holder without using the guide grooves formed in the cutting tool; each pressing member may comprise two separate parts mounted separately on both sides of the cutting tool respectively and may be operated by means of the corresponding individual operating mechanisms for pressing operation.

What is claimed is:

1. A veneer splicing apparatus comprising means for conveying veneer sheets having irregular portions along a feed path in a predetermined direction;

sensors for detecting an irregular end portions of a first veneer sheet to produce a trailing end cutting signal and an irregular leading end portion of a second veneer sheet to produce a leading end cutting signal;

cutting tool means provided above the feed path to cut respective veneer sheets in response to relevent signals, said conveying means being adapted to place said first and second veneer sheets in contacting train to define a splicing line;

means for feeding thermoplastic adhesive material along said feed path to cross said veneer splicing line; and cold pressing means carried by said cutting tool means and adapted to slide relative to said cutting tool means toward and away from splicing line such that said adhesive material is cold pressed on said first and second veneer sheets.

2. A veneer splicing apparatus according to claim 1, wherein said cutting tool means includes a tool holder adapted to reciprocate toward and away from said feed path and a cutting tool generally extending laterally relative to said feed path.

3. A veneer splicing apparatus according to claim 2, wherein said holder is formed with vertical guide grooves to receive said cold pressing means therein.

4. A veneer splicing apparatus according to claim 1, wherein said cold pressing means includes a plurality of pressing members adapted to vertically move relative to said tool holder and a plurality of pressing elements attached to said respective pressing members to protrude downward and each having an underside surface extending substantially parallelly to the veneer sheets above said splicing line, said pressing members and pressing elements having means for admitting cooling medium thereinto.

5. A veneer splicing apparatus according to claim 4, wherein each pressing element is formed with a vertical groove having a depth greater than the cutting tool to receive the cutting tool therein such that said cold pressing means is guided by said cutting tool.

6. A veneer splicing apparatus according to claim 5, wherein said pressing element having a cutting knife projecting over said underside surface at an upstream side thereof.

* * * * *